US009187307B2

(12) United States Patent
Fox

(10) Patent No.: US 9,187,307 B2
(45) Date of Patent: Nov. 17, 2015

(54) FUEL SURGE ARRESTOR

(71) Applicant: Garry Fox, Fort Pierce, FL (US)

(72) Inventor: Garry Fox, Fort Pierce, FL (US)

(73) Assignee: FOX ENVIRONMENTAL PRODUCTS, LLC, Fort Pierce, FL (US)

( * ) Notice: Subject to any disclaimer, the term of this patent is extended or adjusted under 35 U.S.C. 154(b) by 0 days.

(21) Appl. No.: 14/248,930

(22) Filed: Apr. 9, 2014

(65) Prior Publication Data

US 2015/0291407 A1 Oct. 15, 2015

(51) Int. Cl.

| | |
|---|---|
| ***B67C 11/02*** | (2006.01) |
| ***B67D 7/04*** | (2010.01) |
| *B67C 11/00* | (2006.01) |

(52) U.S. Cl.

CPC . *B67C 11/02* (2013.01); *B67D 7/04* (2013.01); *B67C 2011/30* (2013.01)

(58) Field of Classification Search

CPC ..... B67C 11/00; B67C 11/02; B67C 2011/30
USPC ..... 141/286, 331–345, 350; 220/86.2
See application file for complete search history.

(56) References Cited

U.S. PATENT DOCUMENTS

| | | | | | |
|---|---|---|---|---|---|
| 1,437,916 | A | * | 12/1922 | Shelor | 141/45 |
| 3,211,195 | A | | 10/1965 | Porter | |
| 3,291,165 | A | * | 12/1966 | Fraylick | 141/286 |
| 3,687,335 | A | | 8/1972 | Hunter | |
| 3,791,422 | A | * | 2/1974 | Johnson et al. | 141/11 |
| 3,885,606 | A | * | 5/1975 | Krauss | 141/71 |
| 3,893,918 | A | * | 7/1975 | Favret, Jr. | 210/744 |
| 4,031,294 | A | | 6/1977 | Sano | |
| 4,170,252 | A | | 10/1979 | Peterson | |
| 4,903,672 | A | | 2/1990 | MacKinnon | |
| 4,969,494 | A | * | 11/1990 | Chefson | 141/93 |
| 5,033,517 | A | * | 7/1991 | Bucci | 141/59 |
| 5,048,723 | A | | 9/1991 | Seymour | |
| 5,159,958 | A | | 11/1992 | Sand | |
| 5,377,728 | A | | 1/1995 | McLeighton | |
| 5,462,254 | A | | 10/1995 | Muller | |
| 5,472,025 | A | | 12/1995 | Conrad et al. | |
| 5,503,199 | A | * | 4/1996 | Whitley et al. | 141/312 |
| 5,571,249 | A | * | 11/1996 | Boylen | 141/86 |
| 5,715,876 | A | | 2/1998 | Burt | |
| 5,762,114 | A | | 6/1998 | Petersen | |
| 5,787,944 | A | * | 8/1998 | Sarkis et al. | 141/300 |
| 5,878,795 | A | | 3/1999 | Armellino | |
| 6,098,678 | A | | 8/2000 | Shears | |
| 6,247,492 | B1 | | 6/2001 | Stuart | |
| 6,609,870 | B2 | * | 8/2003 | Williams et al. | 414/291 |
| 6,880,593 | B1 | | 4/2005 | Swane | |

(Continued)

FOREIGN PATENT DOCUMENTS

| | | |
|---|---|---|
| EP | 0216240 A2 | 4/1987 |
| EP | 0927699 A1 | 7/1999 |

(Continued)

*Primary Examiner* — Timothy L Maust

(74) *Attorney, Agent, or Firm* — Kilpatrick Townsend & Stockton LLP

(57) ABSTRACT

A fuel surge arrestor can include a funnel shaped to fit within a fuel fill receptacle of a craft. The funnel can have a nozzle opening for accepting a fuel fill nozzle. A vent can be located at a top opening of the funnel. The vent can include a plurality of baffles that enable airflow within the vent while deterring heavy vapors and liquids from exiting the vent during a fuel surge.

14 Claims, 8 Drawing Sheets

(56) References Cited

U.S. PATENT DOCUMENTS

| | | | | |
|---|---|---|---|---|
| 8,511,341 | B2 | 8/2013 | Johnston | |
| 8,522,838 | B2 | 9/2013 | Gurtatowski | |
| 8,555,937 | B2 | 10/2013 | Murabayashi et al. | |
| 2007/0256755 | A1 * | 11/2007 | King | 141/340 |
| 2010/0065137 | A1 | 3/2010 | Armellino | |
| 2010/0236657 | A1 | 9/2010 | Willey et al. | |
| 2013/0078878 | A1 | 3/2013 | Sayer | |
| 2013/0292386 | A1 | 11/2013 | Klauer et al. | |
| 2013/0340890 | A1 | 12/2013 | Matsuo et al. | |

FOREIGN PATENT DOCUMENTS

| | | | |
|---|---|---|---|
| EP | 1345811 | B1 | 9/2003 |
| EP | 1676063 | B1 | 7/2006 |
| EP | 2631211 | A1 | 8/2013 |
| WO | 96/30252 | A1 | 10/1996 |
| WO | 98/51610 | A1 | 11/1998 |
| WO | 2013/043379 | A1 | 3/2013 |
| WO | 2014/022083 | A1 | 2/2014 |

* cited by examiner

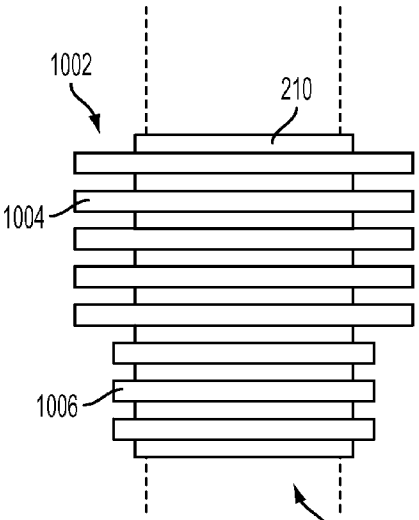
FIG. 10A
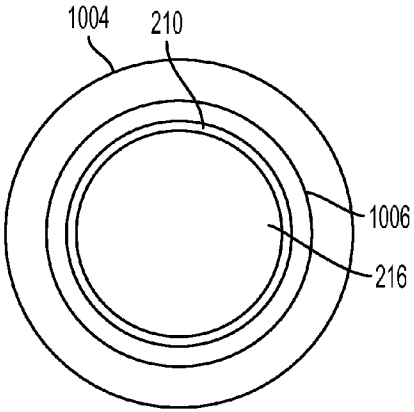
FIG. 10B
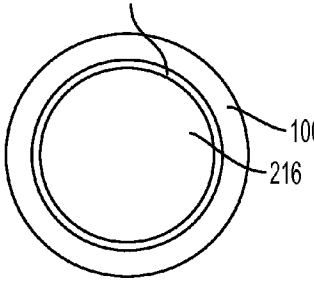
FIG. 11A
FIG. 11B
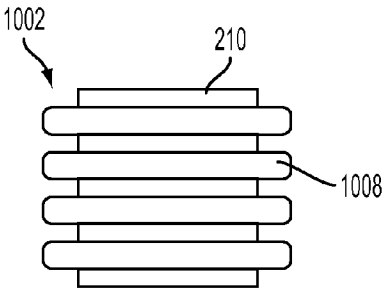
FIG. 12

FUEL SURGE ARRESTOR

TECHNICAL FIELD

The present disclosure relates to fuel filling devices generally and more specifically to fuel filling devices for boating.

BACKGROUND

In boating and other activities using fuel-powered crafts (e.g., motorcycles, cars, etc), fuel tanks must be refilled on occasion. Often, fuel tanks are refilled from fuel pumps, such as those found on land at standard pumping stations and those found near the water at marine piers. The fuel pumps generally pump fuel out through a nozzle that can be positioned within a fuel fill receptacle of the craft.

A common occurrence when refueling boats and other crafts is a back surge or "fuel surge," sometimes referred to as a "belch." The fuel surge is a surge of fuel and vapors that are expelled out of the fuel fill receptacle during refueling. In boating, the fuel surge can be especially problematic, because it can often result in spillage of fuel onto and over the side of the craft, potentially into surrounding water. Fuel surge results in waste, and more importantly, can cause environmental problems. To combat these environmental problems, many marine fuel filling stations supply boaters with supplies (e.g., paper towels and dispersant sprays) to clean up fuel spills, however these supplies can end up resulting in further waste and additional environmental problems. In addition to the loss of fuel during a fuel surge, loss of vapors can result in waste and environmental problems.

SUMMARY

Statements containing the term embodiment should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

A fuel surge arrestor is disclosed including a funnel and a vent which can be a unitary structure or separable structures. The funnel is shaped to fit within a fuel fill receptacle of a craft. The funnel can include nozzle opening for accepting a fuel fill nozzle. During a fuel surge, expelled fuel is expelled into the funnel and allowed to flow back into the fuel fill receptacle. The vent extends from the top of the funnel and can include a plurality of baffles that enable airflow within the vent while deterring heavy vapors and liquids from exiting the vent. During a fuel surge, expelled vapors can be lifted into the vent and blocked from exiting the vent by the baffles. Heavy vapors can then fall back into the fuel fill receptacle via the funnel.

BRIEF DESCRIPTION OF THE DRAWINGS

The specification makes reference to the following appended figures, in which use of like reference numerals in different figures is intended to illustrate like or analogous components

FIG. 10A is a side view of a stem having a ribbing section according to one embodiment.

FIG. 10B is a bottom view of the stem of FIG. 10A according to one embodiment.

FIG. 11A is a side view of a stem having a ribbing section according to one embodiment.

FIG. 11B is a bottom view of the stem of FIG. 11A according to one embodiment.

FIG. 12 is a side view of a stem having a ribbing section according to one embodiment.

DETAILED DESCRIPTION

A fuel surge arrestor is disclosed including a funnel and a vent which can be a unitary structure or separable structures. The funnel is shaped to fit within a fuel fill receptacle of a craft. The funnel can include nozzle opening for accepting a fuel fill nozzle. During a fuel surge, expelled fuel is expelled into the funnel and allowed to flow back into the fuel fill receptacle. The vent extends from the top of the funnel and can include a plurality of baffles that enable airflow within the vent while deterring heavy vapors and liquids from exiting the vent. During a fuel surge, expelled vapors can be lifted into the vent and blocked from exiting the vent by the baffles. Heavy vapors can then fall back into the fuel fill receptacle via the funnel.

The disclosed fuel surge arrestor can advantageously be easily placed on a fuel fill receptacle during a refueling process and easily removed once refueling is complete. Being a portable device, the disclosed fuel surge arrestor can be easily moved between multiple boats, allowing an owner of multiple crafts to use the fuel surge arrestor on multiple crafts, or allowing a refueling station operator to keep a fuel surge arrestor on hand to use with customers. In some embodiments, various parts can be easily disassembled in order to clean the fuel surge arrestor.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

As used herein, the terms "bottom," "top," "down," and "up" are used only to aid in explanation of the accompanying figures and are not to intended to limit the specification or claims in any way.

Figure 1:
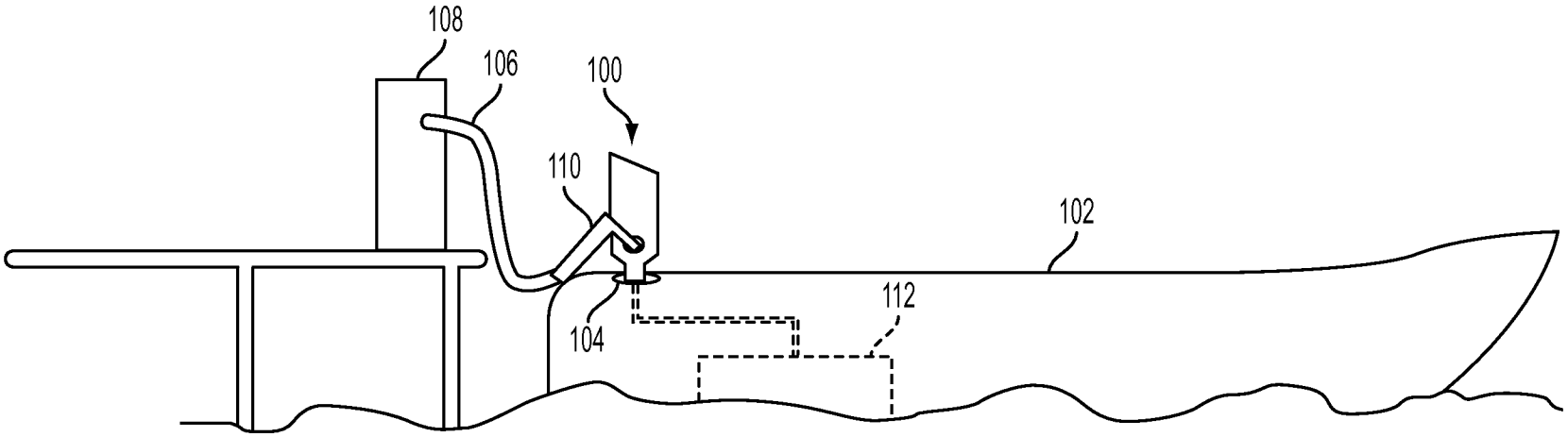
FIG. 1 is a schematic view of a pier-mounted fuel pump refilling a fuel tank of a boat using a fuel surge arrestor according to one embodiment.

FIG. 1 is a schematic view of a pier-mounted fuel pump 108 refilling a fuel tank of a boat 102 using a fuel surge arrestor 100 according to one embodiment. The fuel surge arrestor 100 is placed within a fuel fill receptacle 104 of the boat 102. The fuel fill receptacle 104 is connected to a fuel tank 112. A fuel surge arrestor 100 can be used with different fuel fill receptacles of different crafts other than boats 102, such as motorcycles, cars, trucks, ATVs, lawnmowers, tractors, and other fuel-powered crafts. A fuel surge arrestor 100 can be used to refuel any such crafts at any refueling stations or remote locations where fuel is pumped (e.g., automatically or manually) or poured into a fuel tank 112 of the craft.

The fuel pump 108 can include a fuel fill nozzle 110 attached by a hose 106. The fuel fill nozzle 110 can be designed to be placed within and to dispense fuel directly into a fuel fill receptacle 104 during standard refueling operations. However, as shown in FIG. 1, the fuel surge arrestor 100 can be positioned to accept the fuel fill nozzle 110 and direct dispensed fuel into the fuel fill receptacle 104, as described in further detail below.

Figure 2B:
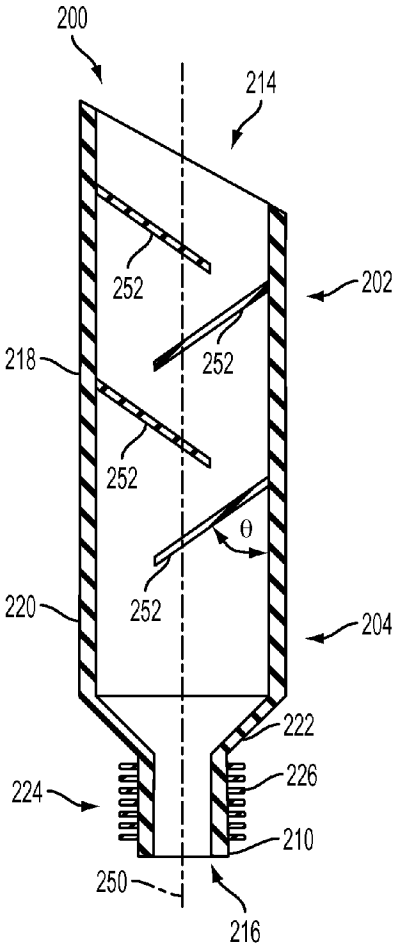
FIG. 2B is a cross-sectional view of the one-piece fuel surge arrestor of FIG. 2A according to one embodiment.
Figure 2A:
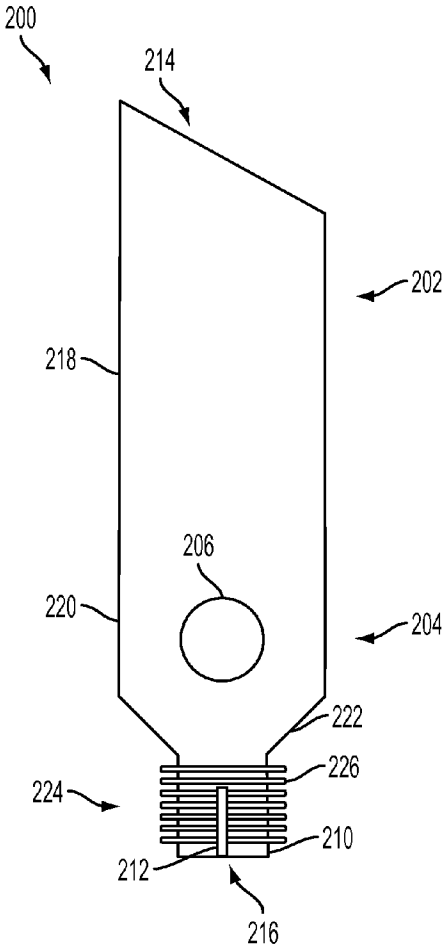
FIG. 2A is a front view of a one-piece fuel surge arrestor according to one embodiment.

FIG. 2A is a front view of a one-piece fuel surge arrestor 200 according to one embodiment. The one-piece fuel surge arrestor 200 is denoted as "one-piece" because the funnel 204 and vent 202 are not separable. The funnel 204 and vent 202 of this one-piece fuel surge arrestor 200 can be made of one part (e.g., formed from a single piece of material) or can be made of multiple parts attached together (e.g., welded, glued, or otherwise permanently joined together).

The vent 202 can include a top opening 214 through which air may enter (e.g., in a direction going down as seen in FIG. 2A). The funnel 204 can include a nozzle opening 206 shaped to accept a fuel fill nozzle 110. In some alternate embodiments, the nozzle opening 206 is located in the vent 202 instead of the funnel 204.

The vent 202 can have a vent wall 218 having a vent wall diameter. The funnel 204 can have a funnel wall 220 having a top diameter at the top end of the funnel 204 and a stem 210 having a stem diameter. The top end of the funnel 204 can be separated from the stem 210 by a reducing section 222. The top diameter can be larger than the stem diameter. The stem diameter can be sized to fit within a fuel fill receptacle 104. The stem diameter can be slightly smaller than 1.5 inches to fit a fuel fill receptacle 104 having a 1.5 inch inner diameter. The stem diameter can be slightly smaller than 2 inches to fit a fuel fill receptacle 104 having a 2 inch inner diameter. The stem diameter can be sized to fit within a desired fuel fill receptacle 104.

In some embodiments, the funnel 204 can include interchangeable stems 210 of different lengths and diameters appropriately sized to fit within the desired fuel fill receptacle 104. In some embodiments, the funnel 204 can include adaptors to adapt a stem 210 designed to fit within a fuel fill receptacle 104 having a particular inner diameter to fit within a fuel fill receptacle 104 having a different inner diameter.

The stem 210 can include a ribbing section 224 having one or more ribbing elements 226. The ribbing elements 226 can be a slightly pliable or very pliable materials, such as rubber, plastic, silicone, or other suitable material. As the stem 210 is inserted into a fuel fill receptacle 104, the ribbing elements 226 can flex to allow insertion. The ribbing elements 226 can engage features of the fuel fill receptacle 104, such as threads. During removal of the stem 210 from the fuel fill receptacle 104, the ribbing elements 226 can flex to allow removal. In embodiments where the stem 210 includes a cap slit 212, as described in further detail below, the ribbing elements 226 can include corresponding slits.

The funnel 204 can include a nozzle opening 206 in the funnel wall 220. The nozzle opening 206 can be sized to accept a fuel fill nozzle 110. The nozzle opening 206 can be circular or any other shape capable of accepting a fuel fill nozzle 110. The nozzle opening 206 can be shaped to facilitate insertion of the fuel fill nozzle 110 so the distal end of the fuel fill nozzle 110 points towards the bottom of the funnel 204.

Often, fuel fill receptacles 104 are covered by a fuel fill receptacle cap that is attached to, near, or within the fuel fill receptacle 104 by a tether (e.g., a chain). The stem 210 can optionally include a cap slit 212. The cap slit 212 can be shaped to accept the tether of a fuel fill receptacle cap, allowing the funnel 204 to sit as completely within the fuel fill receptacle 104 in the event the tether of a fuel fill receptacle cap must pass from within the fuel fill receptacle 104 to outside the fuel fill receptacle 104 during fueling.

FIG. 2B is a cross-sectional view of the one-piece fuel surge arrestor 200 of FIG. 2A according to one embodiment. The fuel surge arrestor 200 has a center axis 250. The vent 202 and funnel 204 define a pathway from the top opening 214, through the vent 202 and the funnel 204, and out of the bottom opening 216.

Arranged within the vent 202 of the fuel surge arrestor 200 lies one or more baffles 252. Baffles 252 can be arranged to allow fluid flow through the pathway, while catching and/or resisting certain fluid flow from the bottom opening 216, up through the pathway, and out the top opening 214. In one embodiment, the baffles 252 can be arranged to allow air to flow through the pathway, but catch liquid and/or heavy vapors that may be expelled upwards through the bottom opening 216 during a fuel surge.

Each baffle 252 can be a unitary structure with the vent wall 218, can be permanently attached to the vent wall 218 (e.g., welded or adhered), or can be removably attached to the vent wall 218 (e.g., the baffle 252 can slide into a slit in the vent wall 218). In alternate embodiments, the baffles 252 are attached to a frame that is positionable within the vent 202. As used herein, the term "extending from" and variations thereof are used to describe the general direction of a dimension (e.g., length, width, or other) of a feature and does not limit the feature from being attached to or formed from any other feature.

Each baffle 252 can extend from the vent wall 218 at an angle θ. The angle θ can be less than 90° (i.e., the baffle 252 can extend from the vent wall 218 at an angle generally towards the funnel 204). In some embodiments, the angle θ can be between approximately 20° and approximately 25°. In some embodiments, the angle θ can be 75° or less. Each baffle 252 can extend from the vent wall 218 at approximately the same angle or at angles different from one another.

Each baffle 252 can extend from the vent wall 218 to partially occlude the pathway. When multiple baffles 252 are used, each baffle 252 can be offset such that two or more baffles 252 overlap one another. Each baffle 252 can extend at least beyond the center axis 250 of the vent 202. Each baffle 252 can extend to occlude at least 55% of the pathway through the vent 202. Each baffle 252 can extend to occlude at least two-thirds of the pathway through the vent 202.

Each baffle 252 can be planar in shape. In alternate embodiments, each baffle 252 can have different shapes (e.g., wing-shaped, corrugated, or other shapes).

Figure 3:
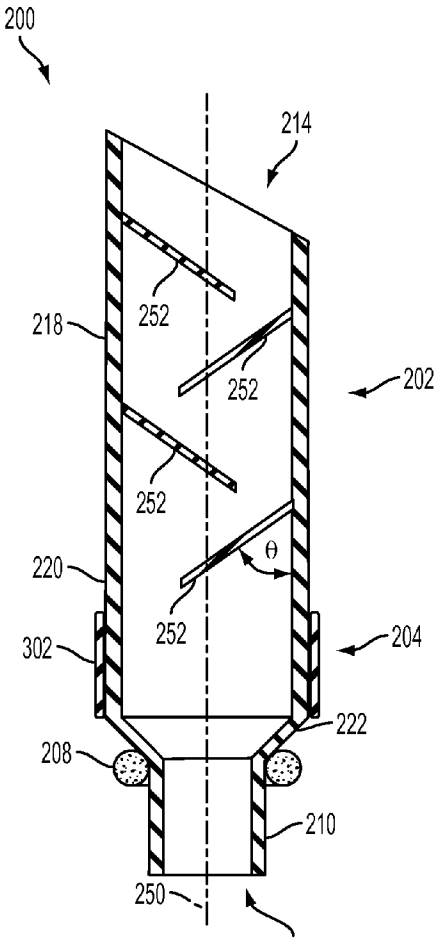
FIG. 3 is a cross-sectional view of a one-piece fuel surge arrestor according to one embodiment.

FIG. 3 is a cross-sectional view of a one-piece fuel surge arrestor 200 according to one embodiment. The stem 210 of the fuel surge arrestor 200 of FIG. 3 is shown having a larger diameter than the stem 210 of the fuel surge arrestor 200 of FIG. 2. In some embodiments, an elastic sleeve 302 can be positioned around the funnel wall 220. The elastic sleeve 302 can help retain the fuel fill nozzle 110 and for other purposes, as described in further detail below.

A gasket 208 can be placed around the stem 210 and/or reducing section 222. The gasket 208 can help seal the funnel 204 with the fuel fill receptacle 104. The gasket 208 can be rubber or any other suitable material. In some embodiments, the gasket 208 can be a ribbed rubber insert. In alternate embodiments, no gasket 208 is used, and instead a ribbed section is used, as described in further detail herein.

Figure 4:
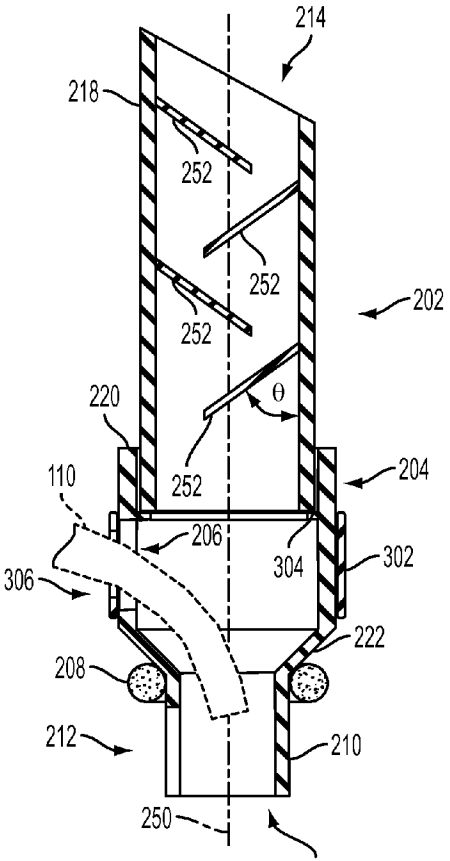
FIG. 4 is a cross-sectional view of a two-piece fuel surge arrestor according to one embodiment.

FIG. 4 is a cross-sectional view of a two-piece fuel surge arrestor 200 according to one embodiment. The fuel surge arrestor 200 includes a funnel 204 and vent 202 that are separate parts. The vent 202 can sit within the funnel 204 and be placed on a shoulder 304 of the funnel 204.

The funnel 204 can include a nozzle opening 206. A fuel fill nozzle 110 is shown in dotted lines. The elastic sleeve 302 is shown having a sleeve opening 306 positioned at the nozzle opening 206. The sleeve opening 306 is sized to accept a fuel fill nozzle 110. Due to the elastic nature of the elastic sleeve 302, the sleeve opening 306 can stretch to best accept the fuel fill nozzle 110 and to reduce the chance that any fluids may escape out of the nozzle opening 206. The elastic sleeve 302 can be made of rubber, plastic, or any other suitable material. In alternate embodiments, other elastic elements can be included in or around the nozzle opening 206.

In some embodiments, the funnel 204 does not include a shoulder 304. In alternate embodiments, the vent 202 can include a feature that ensures the vent wall 218 does not occlude the nozzle opening 206. In some alternate embodiments, the vent wall 218 also includes an opening which aligns with the nozzle opening 206 to allow a fuel fill nozzle 110 to pass through the vent wall 218 when the fuel fill nozzle 110 is inserted through the nozzle opening 206.

Figure 5B:
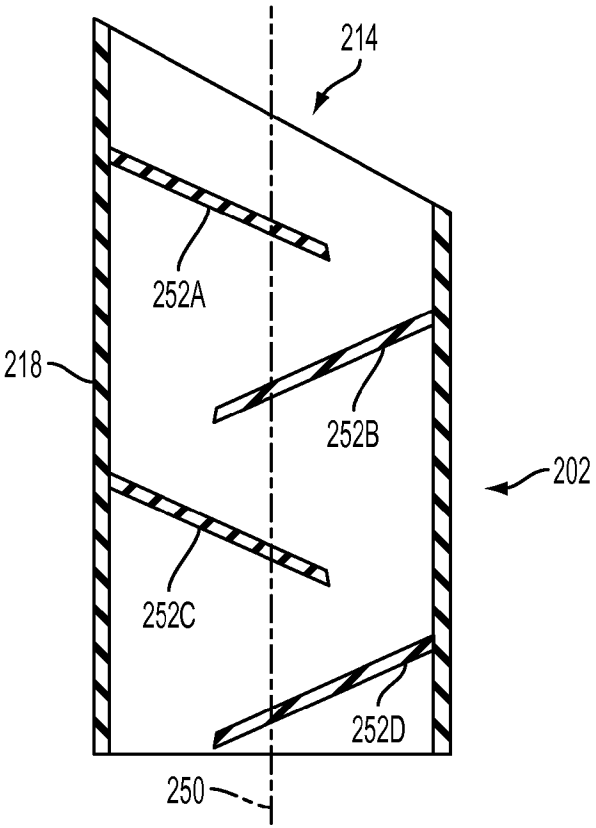
FIG. 5B is a cross sectional view of the vent of FIG. 5A taken along section 5B:5B according to one embodiment.
Figure 5A:
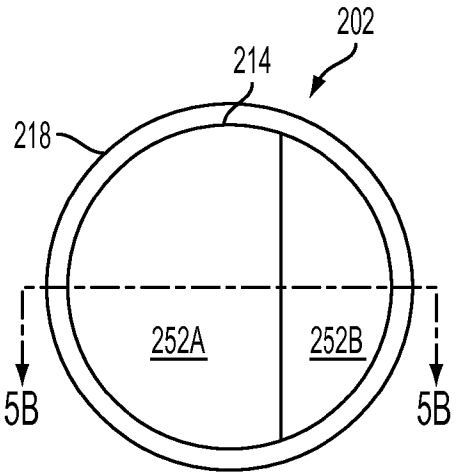
FIG. 5A is a top view of a vent according to one embodiment.

FIG. 5A is a top view of a vent 202 according to one embodiment. The vent wall 218 is shown having a top opening 214. A first baffle 252A is shown partially occluding the pathway through the vent 202 and partially overlapping a second baffle 252B. The first baffle 252A and second baffle 252B together fully occlude a direct, line-of-sight pathway through the vent 202. In alternate embodiments, three or more baffles 252 can be used in concert to fully occlude a direct, line-of-sight pathway through the vent 202. In alternate embodiments, one or more baffles 252 used together can occlude most, but not all, of a direct, line-of-sight pathway through the vent 202.

FIG. 5B is a cross sectional view of the vent 202 of FIG. 5A taken along section 5B:5B according to one embodiment. The first baffle 252A and second baffle 252B are visible through the top opening 214. The third baffle 252C and fourth baffle 252D are present below the first baffle 252A and second baffle 252B.

Figure 6B:
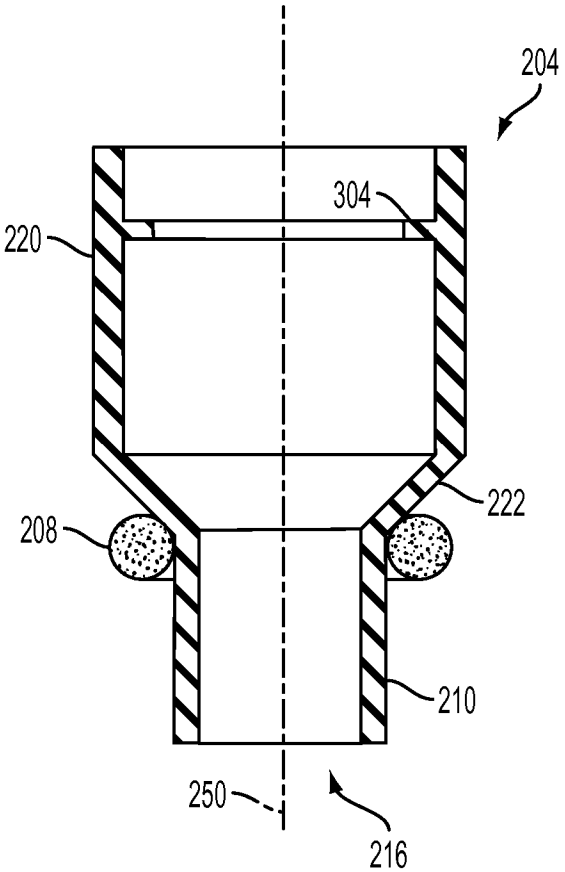
FIG. 6B is a cross sectional view of the funnel of FIG. 6A taken along section 6B:6B according to one embodiment.
Figure 6A:
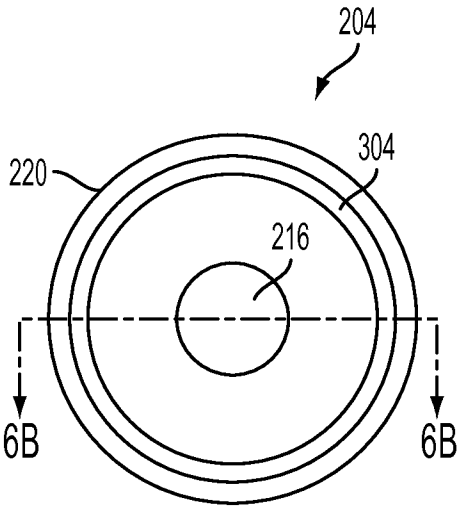
FIG. 6A is a top view of a funnel according to one embodiment.

FIG. 6A is a top view of a funnel 204 according to one embodiment. The funnel wall 220 includes a shoulder 304 upon which a vent 202 can be placed. The funnel 204 includes a bottom opening 216.

FIG. 6B is a cross sectional view of the funnel 204 of FIG. 6A taken along section 6B:6B according to one embodiment. The shoulder 304 is shown upon which a vent 202 can be placed.

Figure 7:
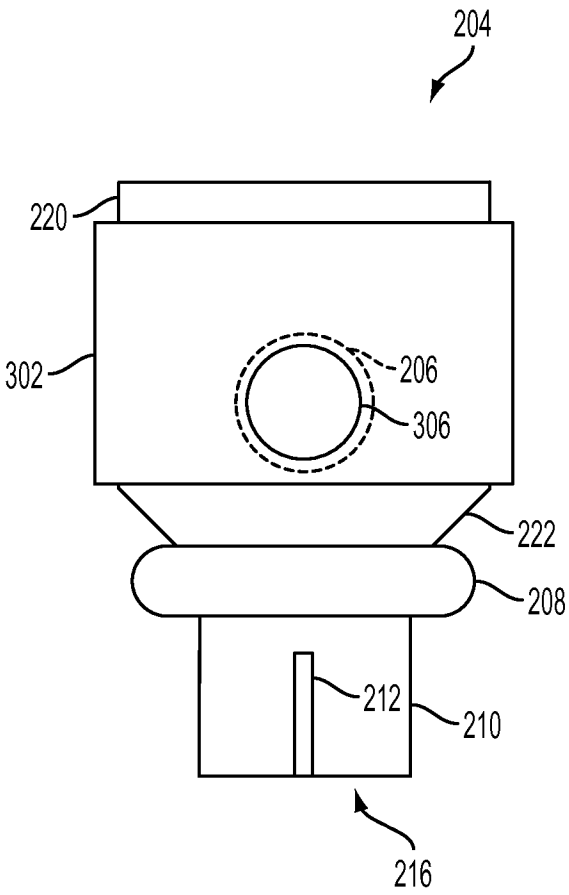
FIG. 7 is a front view of a funnel having a nozzle opening according to one embodiment.

FIG. 7 is a front view of a funnel 204 having a nozzle opening 206 according to one embodiment. The funnel 204 includes an optional elastic sleeve 302. The elastic sleeve 302 has a sleeve opening 306 that aligns with the nozzle opening 206 in the funnel 204. The sleeve opening 306 can be smaller than the nozzle opening 206. In alternate embodiments, the sleeve opening 306 is the same size or larger than the nozzle opening 206.

In some embodiments, an insert can be located within the nozzle opening 206 to help with placing a fuel fill nozzle 110 into the funnel 204. The insert can be rubber, plastic, or other suitable material.

Figure 8:
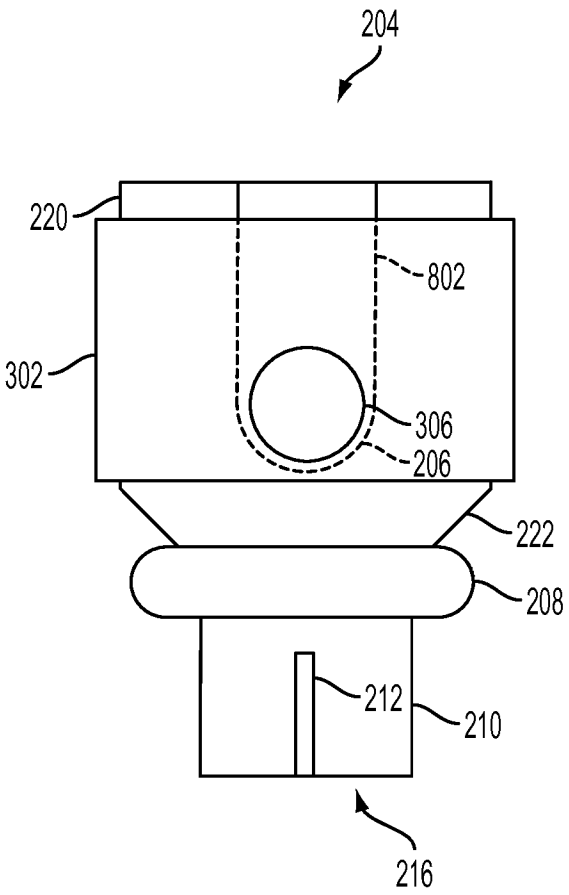
FIG. 8 is a front view of a funnel having a nozzle opening and a slit according to one embodiment.

FIG. 8 is a front view of a funnel 204 having a nozzle opening 206 and a slit 802 according to one embodiment. The slit 802 can allow the funnel wall 220 to flex radially outwards. In some embodiments, the vent 202 can be held in place in the funnel 204 by a friction fit between the funnel wall 220 and the vent wall 218. In some embodiments, the slit 802 allows the funnel wall 220 to flex outwards sufficiently to allow a vent 202 to be placed inside the funnel 204. Once the vent 202 is placed into the funnel 204, the elastic sleeve 302 can be placed around the funnel 204 to further secure the vent 202 within the funnel 204 and to provide a smaller opening through which a fuel fill nozzle 110 can be inserted.

In some embodiments, an insert can be located within the nozzle opening 206 and/or the slit 802 to help with placing a fuel fill nozzle 110 into the funnel 204. The insert can be rubber, plastic, or other suitable material. In some embodiments, the insert can act as a shoulder that keeps the vent wall 218 from occluding the nozzle opening 206.

Figure 9B:
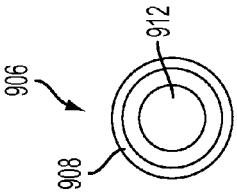
FIG. 9B is a top view of the insert of FIG. 9A according to one embodiment.
Figure 9C:
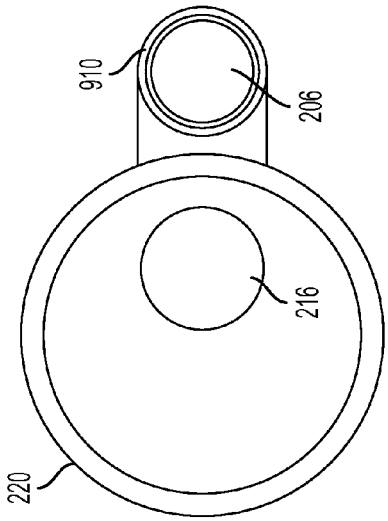
FIG. 9C is a top view of the funnel of FIG. 9A according to one embodiment.
Figure 9A:
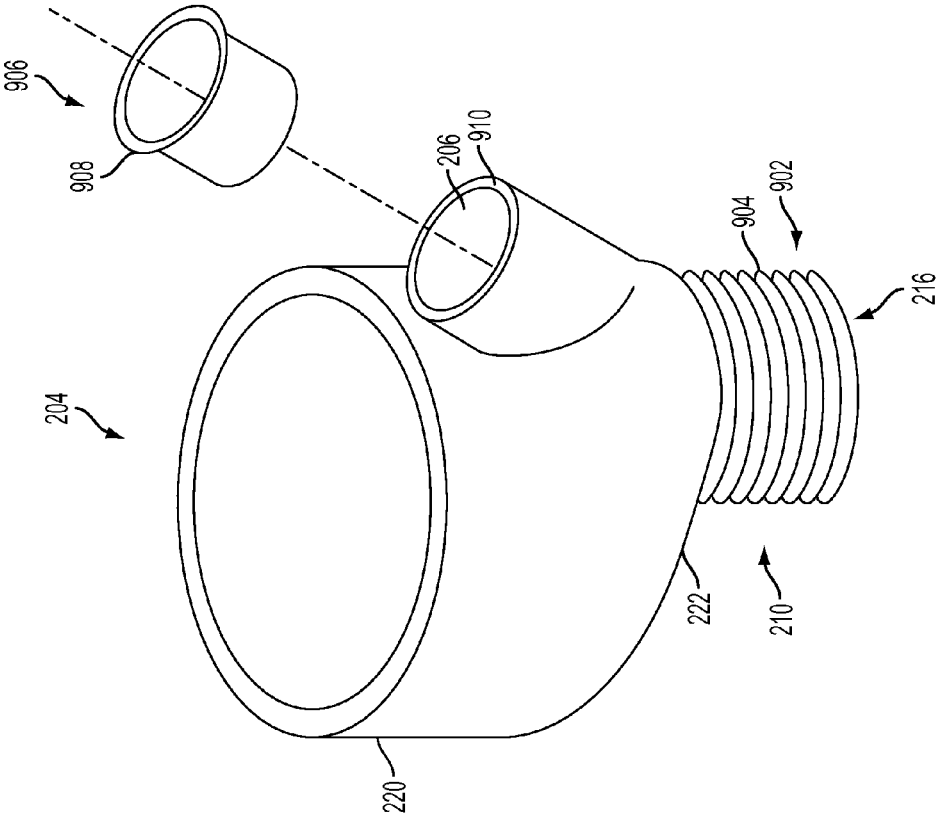
FIG. 9A is a partially-exploded view of a funnel including an offset stem.

FIG. 9A is a partially-exploded view of a funnel 204 including an offset stem 210 according to one embodiment. The funnel 204 includes a funnel wall 220 having a reducing section 222 and a nozzle opening 206. The funnel 204 includes a stem 210 with a bottom opening 216. The funnel 204 can include a stem 210 that is offset from the center of the reducing section 222. Additionally, the nozzle opening 206 can be positioned to direct a fuel fill nozzle 110 into the stem 210. The nozzle opening 206 can be angled to position a fuel fill nozzle 110 so that the tip of the nozzle points out the bottom opening 216 of the funnel 204. The stem 210 can include a ribbing section 902. The ribbing section 902 can include one or more ribbing elements 904 of uniform or varying shapes or diameters, as described in further detail below.

The nozzle opening 206 can include an insert 906. The insert 906 can be shaped to rest within the nozzle opening 206. The insert 906 can include a lip 908 that rests upon a rim 910 of the nozzle opening 206. The insert 906 can be made of a flexible material, such as rubber, silicone, or any other suitable material. The insert 906 can be permanently adhered to or fused to the nozzle opening 206, or can be removably placed within the nozzle opening 206. The insert 906 can include an insert hole 912 through which a fuel fill nozzle 110 can be placed. The insert 906 and the insert hole 912 can flex to tightly fit various sizes and shapes of fuel fill nozzles 110.

FIG. 9B is a top view of the insert 906 of FIG. 9A according to one embodiment. The insert 906 includes a lip 908 that rests on the rim 910 of the nozzle opening 206. The insert 906 includes an insert hole 912.

FIG. 9C is a top view of the funnel 204 of FIG. 9A according to one embodiment. The funnel 204 includes bottom opening 216. The funnel 204 includes a funnel wall 220 and a nozzle opening 206 having a rim 910.

FIG. 10A is a side view of a stem 210 having a ribbing section 1002 according to one embodiment. The stem 210 can include a ribbing section 1002 that includes one or more first ribbing elements 1004 and one or more second ribbing elements 1006. The first ribbing elements 1004 are located further from the bottom opening 216 of the stem 210 and have a larger diameter than the second ribbing elements 1006. The second ribbing elements 1006 are located closer to the bottom opening 216. The use of the first ribbing elements 1004 of a larger diameter than the second ribbing elements 1006 allow for the stem 210 to form tight seals when inserted into fuel fill receptacles 104 having a range of inner diameters, such as between about 1.75 inches to about 2.25 inches. In smaller fuel fill receptacles 104, the second ribbing elements 1006 can create a tight seal while the first ribbing elements 1004 may not be inserted into the fuel fill receptacle 104. In larger fuel fill receptacles 104, the first ribbing elements 1004 can create a tight seal while the second ribbing elements 1006 create a loose seal or no seal within the fuel fill receptacle 104.

In some embodiments, the ribbing elements 1004, 1006 can form a tight seal with the fuel fill receptacle 104 by engaging features of the fuel fill receptacle 104, such as threads.

In some embodiments, a plurality of ribbing elements of varying shapes and diameters can be used to provide tight seals with a plurality of fuel fill receptacles 104 having varying inner diameters.

In some embodiments, the ribbing elements 1004, 1006 can be attached to the stem 210. In alternate embodiments, the ribbing elements 1004, 1006 can be attached to a sleeve that fits around the stem and can be held in place by adhesion, fusing, friction, or other suitable ways. In some embodiments, a user can select the appropriate sleeve having a ribbing section 1002 designed for certain desired fuel fill receptacle 104 diameters and install that sleeve on the stem 210 of that user's funnel 204.

FIG. 10B is a bottom view of the stem 210 of FIG. 10A according to one embodiment. The stem 210 includes a bottom opening 216.

FIG. 11A is a side view of a stem 210 having a ribbing section 1002 according to one embodiment. The stem 210 can include a ribbing section 1002 that includes one or more ribbing elements 1008. The use of a single set of ribbing elements 1008 allow for the stem 210 to form tight seals when inserted into fuel fill receptacles 104 having inner diameters around a particular diameter, such as diameters around approximately 1.50 inches.

In some embodiments, the ribbing elements 1008 can be attached to the stem 210. In alternate embodiments, the ribbing elements 1008 can be attached to a sleeve that fits around the stem and can be held in place by adhesion, fusing, friction, or other suitable ways. In some embodiments, a user can select the appropriate sleeve having a ribbing section 1002 designed for certain desired fuel fill receptacle 104 diameters and install that sleeve on the stem 210 of that user's funnel 204.

FIG. 11B is a bottom view of the stem of FIG. 11A according to one embodiment. The stem 210 includes a bottom opening 216.

FIG. 12 is a side view of a stem 210 having a ribbing section 1002 according to one embodiment. The ribbing section 1002 can have ribbing elements 1008 having a cross-section that is oval in shape. In alternate embodiments, the ribbing section 1002 can have ribbing elements 1004, 1006, 1008 having a cross-section that is square, rounded, or any other suitable shape.

The fuel surge arrestor 100, including the vent 202, funnel 204, baffles 252, and other parts can be made of metal, plastic, or any other suitable material.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A fuel surge arrestor, comprising:

a funnel having a stem insertable in a fuel fill receptacle and a funnel wall;

a sleeve removably couplable about the stem and having an external diameter for establishing a seal with the fuel fill receptacle;

a nozzle opening in the funnel wall for accepting a fuel fill nozzle;

a vent including a vent wall defining a pathway fluidly connected to the funnel adjacent the funnel wall;

at least one baffle extending from the vent wall at an angle generally towards the funnel to partially occlude the pathway; and an additional sleeve removably couplable about the funnel for replacing the sleeve, wherein an external diameter of the additional sleeve is different than the external diameter of the sleeve.

2. The fuel surge arrestor of claim 1, wherein the at least one baffle includes a plurality of offset overlapping baffles, each of the plurality of offset overlapping baffles extending from respective positions on the vent wall at respective angles generally towards the funnel to partially occlude the pathway.

3. The fuel surge arrestor of claim 2, wherein: each of the plurality of offset overlapping baffles extends from a wall of the vent at respective angles between approximately 20° and approximately 25°.

4. The fuel surge arrestor of claim 2, wherein each of the plurality of offset overlapping baffles extends beyond a center axis of the vent.

5. The fuel surge arrestor of claim 4, wherein each of the plurality of offset overlapping baffles occludes at least two-thirds of the pathway.

6. The fuel surge arrestor of claim 2, wherein each of the plurality of offset overlapping baffles is planar in shape.

7. The fuel surge arrestor of claim 1, wherein the stem includes a cap slit for accepting a tether of a fuel fill receptacle cap.

8. The fuel surge arrestor of claim 1, wherein the funnel wall includes a wall slit extending from a top end of the funnel to the nozzle opening.

9. The fuel surge arrestor of claim 8 additionally including an elastic sleeve surrounding the funnel wall.

10. The fuel surge arrestor of claim 9 wherein the elastic sleeve includes a sleeve opening for accepting the fuel fill nozzle.

11. The fuel surge arrestor of claim 1, wherein the funnel and the vent are separable.

12. A fuel surge arrestor system for insertion in a fuel fill receptacle of a craft, including:

a first wall defining a fluid pathway between a top opening and a bottom opening;

a nozzle opening in one of the first wall and a second wall, the nozzle opening shaped to accept a fuel fill nozzle;

a plurality of baffles positioned in an offset overlapping arrangement between the nozzle opening and the top opening, each of the plurality of baffles extending from respective positions on the first wall at respective angles between approximately 20° and approximately 75° generally towards the bottom opening to partially occlude the fluid pathway;

a stem couplable to the second wall and insertable in the fuel fill receptacle;

a sleeve removably couplable about the stem and having an external diameter for establishing a seal with the fuel fill receptacle;

an additional sleeve removably couplable about the funnel for replacing the sleeve, wherein an external diameter of the additional sleeve is different than the external diameter of the sleeve.

13. The fuel surge arrestor system of claim 12, wherein the plurality of baffles extend from respective positions on the first wall at respective angles between approximately 20° and 25°.

14. The fuel surge arrestor system of claim 13, wherein each of the plurality of baffles extends from respective positions on the first wall to occlude at least 55% of the fluid pathway.

* * * * *